United States Patent [19]

Card

[11] 4,103,629

[45] Aug. 1, 1978

[54] LOOPER APPARATUS FOR FORMING CUT PILE AND LOOP PILE IN THE SAME ROW OF STITCHING IN A NARROW GAUGE TUFTING MACHINE

[75] Inventor: Roy T. Card, Chattanooga, Tenn.

[73] Assignee: Card & Co., Inc., Chattanooga, Tenn.

[21] Appl. No.: 808,646

[22] Filed: Jun. 21, 1977

[51] Int. Cl.[2] ..... D05C 15/24

[52] U.S. Cl. ..... 112/79 R

[58] Field of Search ..... 112/79 R, 79 A, 78, 112/270

[56] References Cited

U.S. PATENT DOCUMENTS

| | | | |
|---|---|---|---|
| 2,982,239 | 5/1961 | McCutchen | 112/79 R |
| 3,084,645 | 4/1963 | Card | 112/79 R |
| 3,138,126 | 6/1964 | Card | 112/79 R |

*Primary Examiner*—H. Hampton Hunter

[57] ABSTRACT

A looper apparatus for a narrow gauge, multiple-needle tufting machine including transversely spaced loopers or hooks having spring clips or looper clips attached thereto and cooperating with knives to form cut pile and loop pile in the same row of stitching, in cooperation with a controlled yarn feed, in which the spring clips span or extend over the cutting zone of the hooks, so that each spring clip will not interfere with the adjacent knife of an adjacent hook.

7 Claims, 4 Drawing Figures

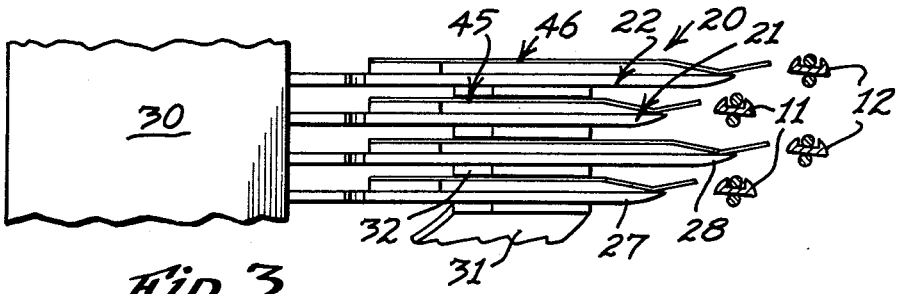
Fig. 3
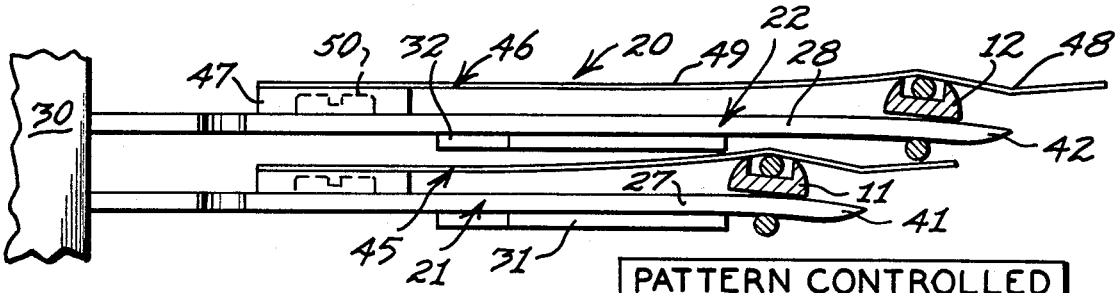
Fig. 4
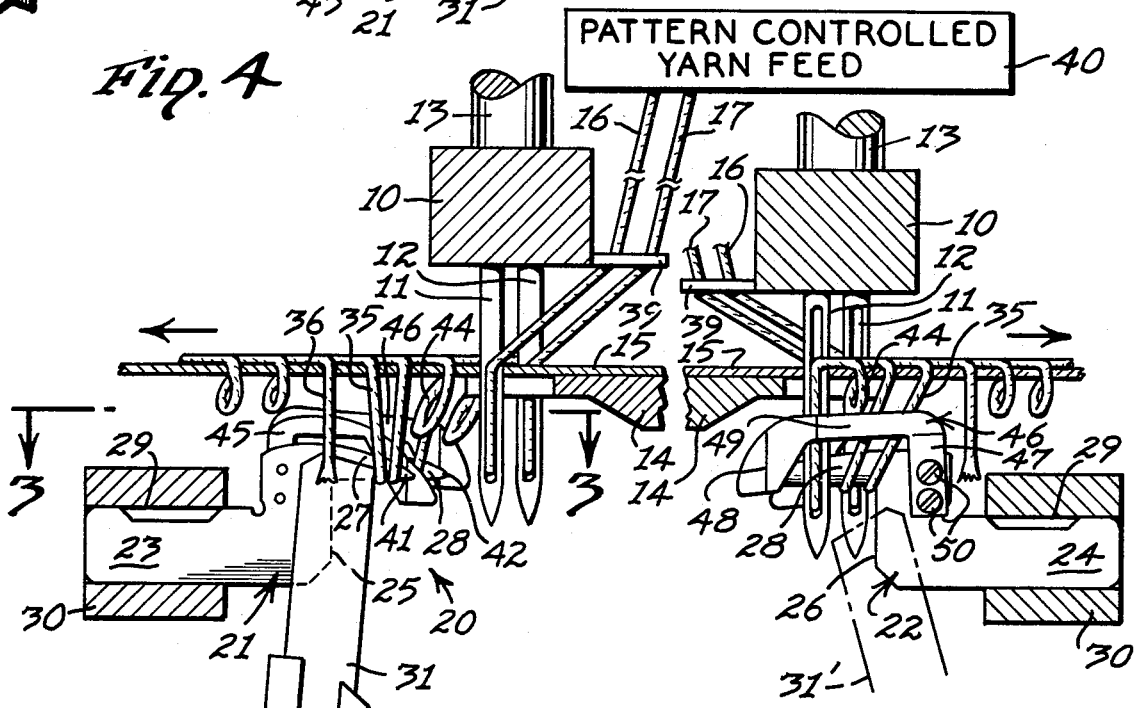
Fig. 2
Fig. 1

LOOPER APPARATUS FOR FORMING CUT PILE AND LOOP PILE IN THE SAME ROW OF STITCHING IN A NARROW GAUGE TUFTING MACHINE

BACKGROUND OF THE INVENTION

This invention relates to tufting machines, and more particularly to a looper apparatus for a narrow gauge, multiple-needle tufting machine adapted to form loop pile and cut pile in the same row of stitching.

In multiple-needle tufting machines having conventional gauges of ¼" or greater, loop pile and cut pile have been formed in the same row of stitching by looper apparatus, such as that disclosed in the Card U.S. Pat. No. 3,084,645, issued Apr. 9, 1963. In the prior Card patent, the looper apparatus includes a hook having a smooth, pointed bill extending in the direction opposite from the direction of fabric feed. A looper clip is fixed to the needle side of each hook and extends along, but is laterally spaced from and below the lower or bottom edge of, the hook, and then terminates in a free end or clamp portion biased into engagement against the free or pointed end portion of the hook. In the prior Card apparatus, the speed of the yarn fed to the needles is selectively controlled by a pattern control mechanism. Normal lengths of yarn are fed to the needles for making a normal length loop pile which is secured and held upon the bill of the looper apparatus and subsequently cut by a knife to form a normal length cut pile tuft. On the other hand, when the pattern control mechanism starves the yarn feed, tension is applied to the yarn caught on the hook and as the hook retracts, the yarn forces the clamping end of the looper clip away from the bill, so that the loop is released and shortened, but is not cut, to thereby form a shorter uncut pile loop.

However, since the trend in the tufting industry is to employ more narrow needle gauges for forming tufted fabrics, such as carpet, the hooks, looper clips and knives become more crowded, as the gauge of the needles is reduced. Where the gauge is reduced to 3/16 of an inch, the knives must be set with more care, thereby requiring more time, so that the looper clips will not interfere with the knives.

When the gauge is reduced to 5/32 of an inch, the setting of knives becomes extremely critical. When the gauge is reduced to ⅛ of an inch, production of tufting fabrics including loop pile and cut pile in the same row of stitching formed by adjacent hooks, knives and looper clips, becomes practically impossible.

Where the gauge is so narrow, the looper clip of one looper interferes with the knife of the adjacent looper.

SUMMARY OF THE INVENTION

It is therefore an object of this invention to provide a looper apparatus for a narrow gauge, multiple-needle tufting machine for forming loop pile and cut pile in the same row of stitching, which avoids the above enumerated problems.

In the looper apparatus for a narrow gauge loop/cut pile tufting machine, made in accordance with this invention, the same type of hooks and knives are used as were employed in the conventional tufting machines, such as those disclosed in the prior Card U.S. Pat. No. 3,084,645.

However, each looper clip attached to a hook has been substantially modified to avoid striking or otherwise interfering with the knife cooperating with the adjacent loop hook.

The looper clip made in accordance with this invention still includes a basic mounting portion, which is preferably fixed to the shank of the hook, and a free end clamping portion biased into engagement with the needle side of the free end or pointed end portion of the hook bill. However, the main body portion of the looper clip connecting the mounting portion to the clamping portion extends above or spans the major portion of the bill. The connecting portion of the looper clip is entirely above the cutting zone of the hook, and specifically is above the path of the reciprocable adjacent knife on the adjacent looper, so that no portion of the looper clip, during the entire operation of the looper apparatus, will engage or interfere with the reciprocably moving, adjacent knife cooperating with the adjacent hook.

Where the hooks and knives are transversely aligned, all portions of the looper clips are transversely disaligned with the knives or knife paths in any operative position.

Thus, each looper clip made in accordance with this invention is preferably made from a unitary spring steel material and is generally arch-shaped, convex upward, so that the main body portion connecting the mounting portion and the clamping portion is at least spaced above the lower cutting edge of the bill, and preferably spaced above the top edge of the bill.

BRIEF DESCRIPTION OF THE DRAWINGS

FIG. 1, is a fragmentary, sectional elevation of a portion of a narrow gauge, staggered needle tufting machine incorporating this invention, disclosing the hooks and knives in cutting positions;

FIG. 2 is an opposite side, fragmentary, elevational view similar to FIG. 1, disclosing the hooks cooperating with the needles in non-cutting position;

FIG. 3 is an enlarged, fragmentary section taken along the line 3—3 of FIG. 1; and FIG. 4 is a further enlarged section, similar to FIG. 3, but disclosing only two of the hooks and looper clips cooperating with the needles for catching or engaging loops.

DESCRIPTION OF THE PREFERRED EMBODIMENT

Referring now to the drawings in more detail, FIGS. 1 and 2 disclose a typical needle bar 10 supporting a plurality of needles 11 in a first or rear transverse row and a plurality of needles 12 in a second or front transverse row spaced longitudinally forward of the first row of needles 11. The needle bar 10 is adapted to reciprocably move between its lower position disclosed in FIG. 2 penetrating the base fabric 15, and an upper position, not shown, above the base fabric 15, by a push rod 13, driven by conventional means, not shown.

As best disclosed in FIG. 3, the needles 11 in the first row and the needles 12 in the second row are alternately staggered transversely of the tufting machine, and are preferably equi-distant from each other, as well as being equi-distantly staggered.

Supported upon a needle plate 14 for movement longitudinally from front to rear in a feeding direction through the tufting machine is the base fabric 15. Each needle 11 carries a yarn 16 and each needle 12 carries a yarn 17 through the base fabric 15 upon each stroke of the needle bar 10.

The looper apparatus 20 made in accordance with this invention may include staggered hooks. However, the looper apparatus 20 disclosed in the drawings includes the transversely aligned hooks 21 and 22 having shanks 23 and 24, and transversely aligned throats 25 and 26. However, bills 27 and 28 of the hooks 21 and 22 are of different lengths so that the free ends 41 and 42 of the bills 27 and 28 are staggered correspondingly with the needles 11 and 12. Each shank 23 and 24 is adapted to be received in a respective slot 29 in the reciprocal hook bar 30.

Furthermore, each hook 21 and 22 is adapted to cooperate with a corresponding knife 31 and 32, respectively, all of which knives are also transversely aligned.

The looper apparatus 20 thus far described in substantially the same as that disclosed in the Card U.S. Pat. No. 4,003,321, used Jan. 18, 1977.

Each of the knives 31 and 32 are identical and mounted in transverse alignment in corresponding knife holders 33 fixed to the reciprocal knife shaft 34 adapted to be rocked or reciprocated in a conventional manner. Each knife 31 and 3 is adapted to cooperate with its corresponding hook 21 and 22 in order to cut loops 35 to form long cut pile tufts 36 formed upon the bills 27 and 28.

The yarns 16 and 17 are fed to the respective needles 11 and 12 through yarn guide 39, fixed to the needle bar 10, from a pattern control yarn feed mechanism 40, of any conventional type, such as that disclosed in the prior Card U.S. Pat. No. 3,084,645.

The pattern control yarn feed apparatus 40 is adapted to selectively reduce the speed of the yarn 16 or 17 fed to the corresponding needle 11 or 12 in order to starve the feed, and create additional tension in the corresponding yarn. Thus, after a loop 35 is formed upon a bill, such as bill 27 in FIG. 1, and additional tension is created in the yarn 16 fed to that particular hook 21, then hook 21 is retracted, and the tensioned loop 35 is backdrawn or pulled off the pointed end 41 of the bill 27 to form a short uncut loop 44.

In order to assist in holding the long loops 35 upon the respective bills 27 and 28, a resilient finger, spring clip or looper clip 45 or 46, respectively, is mounted upon each corresponding hook 21 and 22. Each of the looper clips 45 and 46 may be identical, except in their lengths which correspond to the respective lengths of the bills 27 and 28.

Considering the looper clip 46, disclosed in FIG. 2, as representative of the structure of all the looper clips, the clip 46 is preferably made of a unitary spring steel material, having a free end or clamp portion 48 and an intermediate or connecting portion 49 connecting the mounting portion 47 and the clamp portion 48. The mounting portion 47 is disclosed as being in a substantially vertical attitude and fixed to the rear portion of the bill 28 by screws or rivets 50, or any other convenient type of fastener means. Extending substantially parallel to and above the top edge of the bill 28 is the connecting portion 49, a front portion of which depends to form the creased clamping portion 48, biased into engagement against the free end portion or pointed end portion 42 of the bill 28.

In FIG. 2, the knife 31', which is adjacent to the looper clip 46 and adapted to cooperate with the adjacent hook 21, not shown, but which would be located in front of the plane of the drawing FIG. 2, is disclosed in phantom. The phantom position of the knife 31' in FIG. 2 illustrates that regardless of its operative position, it will not engage, or interfere with, any portion of the looper clip 46. Since each knife 31 and 32 cooperates with the bottom edge of the corresponding bill 27 and 28 and the respective throats 25 and 26, and moves in a substantially elliptical cutting zone relative to those surfaces, the general shape of each looper clip 45 and 46 is generally arched, convex upward, so that any clip 45 or 46 will not interfere with or engage the adjacent knife cooperating with the adjacent looper. It will be particularly noted that the mounting portion 47 is located rearward of the corresponding throat 26, and the connecting portion 49 is located substantially above, not only the lower edge, but also the upper edge, of the corresponding bill 27 and 28, so that the path of the knife is completely clear of any portion of the corresponding looper clip 45 or 46.

When all of the hooks 21 and 22 are transversely aligned, as well as the knives 31 and 32, then no portion of the looper clips 45 and 46 are in transverse alignment with the knives in any position. In other words, all of the looper clips 45 and 46 are transversely disaligned from the cutting zones of their corresponding hooks, or any portion of the paths of the knives.

Otherwise, the looper clips or spring clips 45 and 46 function in the same manner as they do in the prior Card U.S. Pat. No. 3,084,645, insofar as the holding of the long loops 35 upon the respective bills to permit cutting thereof, and the yielding against the tension of the backdrawn yarns in order to create the short uncut pile loops 44.

However, only the looper clips 45 and 46 are adapted to operate successfully where the needle gauges are as small as ⅛ of an inch, a gauge in which looper apparatus such as those disclosed in the prior Card U.S. Pat. No. 3,084,645 could not successfully function.

It will be understood that the clamping portions 48 of the respective spring clips 45 and 46 may be constructed in a similar manner to the clamping portions of the spring clips in the prior Card U.S. Pat. No. 3,084,645. That is, the clamping portion 48 may have a vertical crease therein, with its free end portion flaring laterally away from the corresponding pointed end of the bill 27 or 28, in order to guide the respective needle 11 or 12 between the respective spring clip 45 or 46 and its corresponding bill 27 or 28, as disclosed in FIG. 4.

After the needles 11 and 12 have moved upward above their respective spring clips 45 and 46, the clamping portion 48 will immediately spring back into engagement with the corresponding pointed ends 41 and 42 to prevent any loops formed upon the respective bills 27 and 28 from being pulled off the respective hook 21 or 22, unless the yarn in that particular loop is backdrawn because of the slow or starved feeding of the pattern control yarn feed apparatus 40.

The elasticity of each of the spring clips 45 and 46 is such that the backdrawn yarn will force the clamping portion 48 away from the hook bill to release the tensioned loop 44.

What is claimed is:

1. In a narrow gauge tufting machine having means for supporting the base fabric for longitudinal movement in the feeding direction through said machine, a plurality of transversely spaced reciprocal needles for introducing yarns through the base fabric to form loops, means for selectively controlling the length of a yarn fed to each of said needles, looper apparatus comprising:

(a) a hook for each needle cooperating with said corresponding needle to form a loop thereon, (b) each of said hooks having a shank and a bill projecting longitudinally from said shank and terminating in a free end portion, (c) reciprocal hook bar means supporting said hooks transversely spaced apart with said free end portions extending in the direction opposite said feeding direction, (d) a knife for each hook, (e) knife supporting means supporting said knives transversely so that each knife cooperates with the bill of a corresponding hook for cutting a loop on said bill, (f) a looper clip having a mounting portion, a clamping portion and a connecting portion connecting said mounting portion to said clamping portion, (g) means securing said mounting portion in fixed relationship to said corresponding hook to normally bias said clamping portion against the free end portion of said bill to normally hold loops formed on said bill, but yieldable to predetermined yarn tension in a loop on said bill to force said clamping portion away from said bill to permit said tensioned loop to be withdrawn from the free end of said hook to form an uncut loop, and (h) said connecting portion being above a knife adjacent said corresponding hook, and all portions of said looper clip being in transverse disalignment with said knife adjacent said corresponding hook.

2. The invention according to claim 1 in which each of said bills has a top edge and a bottom edge, each knife cooperating with the bottom edge of a corresponding hook to cut loops thereon to form cut pile loops, said connecting portion of said looper clip being spaced above the bottom edge of said corresponding hook.

3. The invention according to claim 2 in which said connecting portion is spaced above the top edge of said corresponding hook.

4. The invention according to claim 1 in which said mounting portion is fixed to said shank.

5. The invention according to claim 1 in which said hook has first and second planar sides, said looper clip being mounted against one of said planar sides, and said corresponding knife being mounted to cooperate with said second planar side of said corresponding hook, said knife being transversely disaligned with the adjacent loopr clip on said adjacent hook, so that none of said looper clips will interfere with the operation of said knives.

6. A looper apparatus for a tufting machine comprising:

(a) a hook comprising a shank having a mounting portion adapted to be mounted on the hook bar of a tufting machine, and a bill projecting from said shank and terminating in a free end portion, (b) said bill having a top edge and a bottom edge converging into said free end portion, (c) said bill comprising a cutting zone adapted to cooperate with a knife in said tufting machine to cut tufted loops on said bill, (d) a spring clip having a body portion and a clamp portion, (e) means mounting said body portion upon said hook to normally bias said clamp portion against the free end portion of said bill, said body portion extending above said cutting zone, and all portions of said spring clip being transversely disaligned with said cutting zone.

7. The invention according to claim 6 in which said spring clip is generally arch-shaped, convex upward, said body portion including a clip mounting portion fixed to said shank and an upper connecting portion connecting said clip mounting portion to said clamp portion, said connecting portion being spaced above the top edge of said bill.

* * * * *